US008602339B2

(12) United States Patent
Yamaguchi et al.

(10) Patent No.: US 8,602,339 B2
(45) Date of Patent: Dec. 10, 2013

(54) VERTICAL MILL

(75) Inventors: Yoshiki Yamaguchi, Minato-ku (JP); Kenichi Arima, Minato-ku (JP); Yutaka Iida, Minato-ku (JP); Yoshishige Uematsu, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/698,117

(22) PCT Filed: May 13, 2011

(86) PCT No.: PCT/JP2011/061079

§ 371 (c)(1),
(2), (4) Date: Nov. 15, 2012

(87) PCT Pub. No.: WO2011/145527

PCT Pub. Date: Nov. 24, 2011

(65) Prior Publication Data

US 2013/0056569 A1 Mar. 7, 2013

(30) Foreign Application Priority Data

May 19, 2010 (JP) ..... 2010-115484

(51) Int. Cl.
*B02C 15/00* (2006.01)
*B02C 15/04* (2006.01)

(52) U.S. Cl.
USPC ..... 241/121; 241/117; 241/120

(58) Field of Classification Search
USPC ..... 241/117, 120, 121
See application file for complete search history.

(56) References Cited

U.S. PATENT DOCUMENTS

| | | | | |
|---|---|---|---|---|
| 5,875,977 | A * | 3/1999 | Kozlak et al. | 241/18 |
| 6,824,088 | B2 * | 11/2004 | Robinson | 241/121 |
| 7,028,934 | B2 * | 4/2006 | Burynski et al. | 241/121 |
| 2005/0133646 | A1 * | 6/2005 | Holcomb et al. | 241/169 |
| 2009/0127362 | A1 * | 5/2009 | Euculano et al. | 241/117 |
| 2009/0261190 | A1 * | 10/2009 | Hoffmann et al. | 241/63 |

FOREIGN PATENT DOCUMENTS

| | | | |
|---|---|---|---|
| JP | 35-12681 | 6/1960 | |
| JP | 2001-70813 | 3/2001 | |
| JP | 2001-070813 A * | 3/2001 | B02C 15/04 |
| JP | 2008-043926 | 2/2008 | |
| JP | 2009-291692 | 12/2009 | |

OTHER PUBLICATIONS

International Search Report issued Aug. 16, 2011 in International (PCT) Application No. PCT/JP2011/061079.

* cited by examiner

*Primary Examiner* — Dana Ross
*Assistant Examiner* — Onekki Jolly
(74) *Attorney, Agent, or Firm* — Wenderoth, Lind & Ponack, L.L.P.

(57) ABSTRACT

In a vertical mill, a pulverization table is supported with a vertical rotation axis core in a housing so as to be capable of being driven and rotated, and a pulverization roller rotatable in conjunction with rotation of the pulverization table is disposed above the pulverization table so as to be opposed to the pulverization table, and a roller swing mechanism is provided so as to make the pulverization roller parallel to a surface of the pulverization table and swingable in a direction different from a direction of rotation of the pulverization table. Accordingly, a solid matter such as biomass can be efficiently pulverized, thereby achieving improvement in pulverization efficiency.

8 Claims, 3 Drawing Sheets

VERTICAL MILL

BACKGROUND OF THE INVENTION

I. Field of the Invention

The present invention relates to a vertical mill that pulverizes a solid matter such as biomass into fine powder.

II. Description of the Related Art

Combustion facilities for boiler power generation and others use fossil fuel, such as coal and heavy oil in many cases. The fossil fuel contributes to global warming due to a CO2 emission problem. Accordingly, the utilization of fuel using biomass as a substitute for the fossil fuel is promoted. The biomass is an organic object resulting from photosynthesis, which includes woody, herbaceous, crops, garbage, and the like. In one of combustion methods using biomass as fuel, a biomass solid matter is pulverized into fine powder and supplied to a pulverized coal-fired boiler. This method is divided into two known methods: a single pulverization method in which coal and biomass are separately pulverized; and a mixture pulverization method in which coal and biomass are mixed and pulverized. In both of the methods, a biomass pulverization device is needed to pulverize a biomass solid matter.

In this case, coal is pulverized by the use of a vertical roller mill, but a biomass solid matter has stretch properties and is inferior in crushability as compared with coal. It is thus difficult to pulverize the biomass solid matter into a predetermined size by the vertical roller mill for coal. Therefore, biomass solid matters are conventionally pulverized by the use of pulverizers such as a hammer mill, a cutter mill, and the like. However, pulverization of a biomass solid matter using a hammer mill, a cutter mill, or the like, requires a great deal of power. This causes deterioration in efficiency of the pulverizers and shortens lifetimes of the pulverizers with the need for maintenance in short-term cycles, which makes it difficult to operate the pulverizers continuously.

The following patent documents and others suggest biomass pulverization devices using a vertical mill. For example, the biomass pulverization device disclosed in Japanese Patent Application Laid-Open No. 2009-291692 presses and pulverizes a biomass solid matter supplied on a rotating pulverization table, by a roller operating in conjunction with rotation of the table, and delivers the pulverized biomass upward by a flowing air current from a lower part, and then classifies the biomass into coarse powder and fine powder. In addition, the biomass pulverization device disclosed in Japanese Patent Application Laid-Open No. 2008-043926 controls a pressing force of a roller and a rotating speed of a table so as to fall within specific ranges in which to facilitate mutual grinding of biomass chips, according to the distance between the roller and the table.

SUMMARY OF THE INVENTION

However, biomass solid matters are high in fiber and soft, and thus it is difficult to pulverize efficiently the biomass solid matters only by a compression force of the roller unless there are large amounts of power and time. This causes a problem of lower pulverization efficiency.

To solve the foregoing problem, an object of the present invention is to provide a vertical mill that efficiently pulverizes solid matters such as biomass, thereby achieving improvement in pulverization efficiency.

According to an aspect of the present invention, a vertical mill includes: a pulverization table supported with a vertical rotation axis core in a housing so as to be driven and rotated;

a pulverization roller that is disposed above the pulverization table so as to be opposed to the pulverization table and is rotatable in conjunction with rotation of the pulverization table; and a roller swing mechanism that makes the pulverization rollers parallel to a surface of the pulverization table and swingable in a direction different from a direction of rotation of the pulverization table.

Therefore, when the pulverization table is driven and rotated and a solid matter such as biomass is supplied onto the pulverization table, the solid matter moves outward by a centrifugal force and enters between the pulverization table and the pulverization roller, and then the solid matter is pulverized by rotation of the pulverization roller in conjunction with rotation of the pulverization table. At that time, the roller swing mechanism allows the pulverization roller to swing to exert a shearing force on the solid matter, thereby facilitating pulverization of the solid matter. Accordingly, the solid matter such as biomass can be pulverized efficiently, thereby achieving improvement in pulverization efficiency.

Advantageously, in the vertical mill, the roller swing mechanism causes the pulverization roller to swing around a pulverization position of the pulverization roller on the pulverization table or a position nearer a radial outside of the pulverization table than the pulverization position, as a fulcrum point.

Therefore, the pulverization roller swings with the pulverization position or the position outward than the pulverization position, as a point of support, thereby to exert a shearing force efficiently on the solid matter such as biomass. Accordingly, it is possible to cut biomass fiber and pulverize the solid matter efficiently.

Advantageously, in the vertical mill, a support shaft is provided with a base end part supported by the housing and a leading end part facing a rotation axis core of the pulverization table, a base end part of the swing shaft is swingably connected to a leading end part of the support shaft via a connecting shaft extending in approximately vertical direction, and the pulverization roller is rotatably supported at the leading end part of the swing shaft.

Therefore, the pulverization roller swings by swinging of the swing shaft with respect to the support shaft. Accordingly, the pulverization roller can easily be supported in a manner capable of swinging.

Advantageously, in the vertical mill, the roller swing mechanism includes an actuator that causes the pulverization roller to swing.

Therefore, it is possible to swing easily the pulverization roller by the actuator. In this case, the actuator can be formed by a hydraulic cylinder, an air cylinder, a motor, or the like.

Advantageously, in the vertical mill, the roller swing mechanism includes a biasing member that biases the pulverization roller to an upstream side of direction of rotation of the pulverization table.

Therefore, the pulverization roller swings to a downstream side of the direction of rotation by transfer of a rotative force of the pulverization table. Meanwhile, when the rotative force of the pulverization table is lowered depending on pulverization state of the solid matter, the pulverization roller swings to the upstream side of the direction of rotation due to a biasing force of the biasing member. Accordingly, it is possible to swing easily the pulverization roller in a simple configuration.

According to the vertical mill of the present invention, the pulverization roller is disposed above the pulverization table so as to be opposed to the pulverization table, and the pulverization roller is configured by the roller swing mechanism to be swingable along the surface of the pulverization table and in a direction different from the direction of rotation of the pulverization table, which allows the solid matter such as biomass to be efficiently pulverized, thereby achieving improvement in pulverization efficiency.

DETAILED DESCRIPTION OF THE INVENTION

With reference to the attached drawings, preferred embodiments of a vertical mill according to the invention will be described below in detail. However, the present invention is not limited by these embodiments.

Embodiment 1

Figure 1:
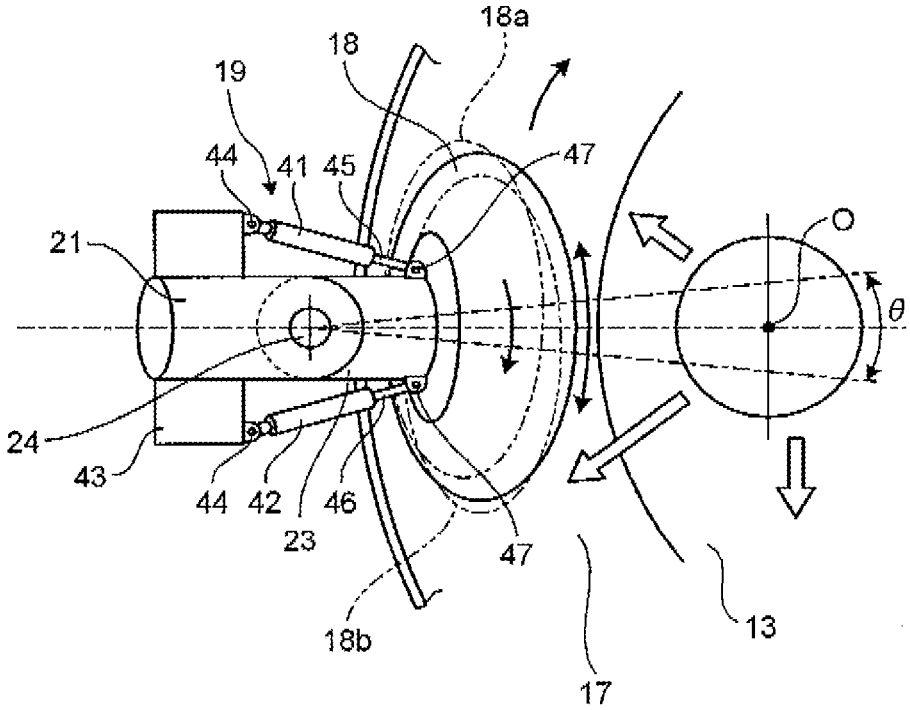
FIG. 1 is a plan view of a pulverization roller in a vertical mill according to embodiment 1 of the present invention.
Figure 2:
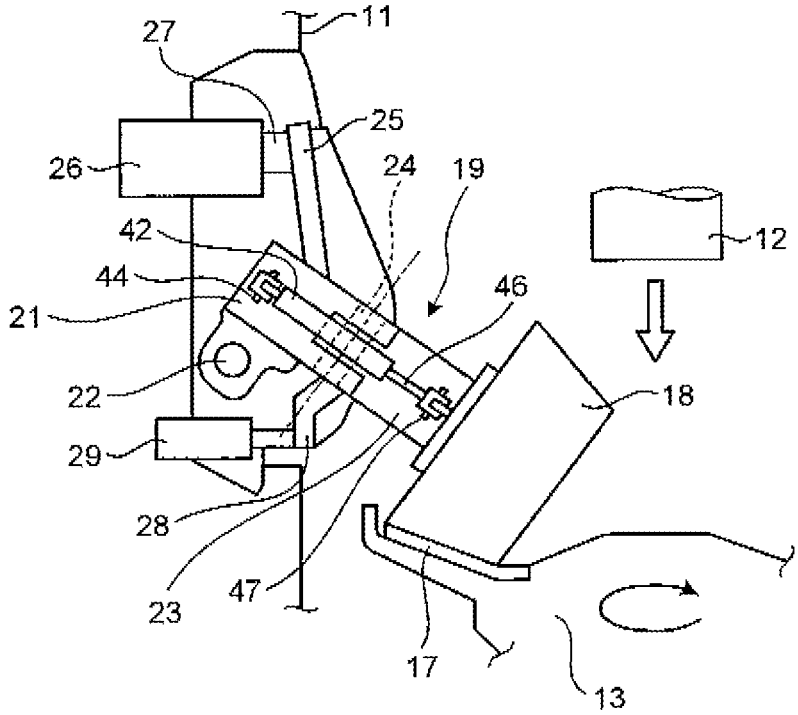
FIG. 2 is a front view of the pulverization roller in the vertical mill of embodiment 1.
Figure 3:
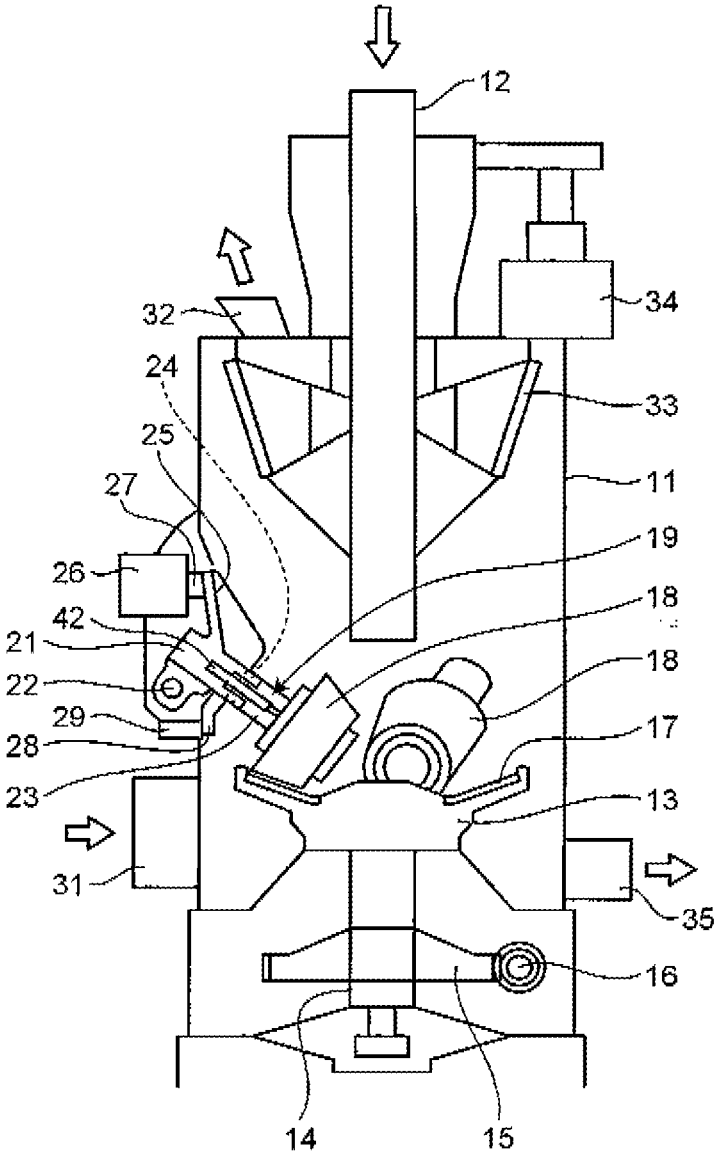
FIG. 3 is a schematic configuration diagram of the vertical mill of embodiment 1.

FIG. 1 is a plan view of a pulverization roller in a vertical mill according to embodiment 1 of the present invention, FIG. 2 is a front view of the pulverization roller in the vertical mill of embodiment 1, and FIG. 3 is a schematic configuration diagram of the vertical mill of embodiment 1.

The vertical mill of embodiment 1 is intended to pulverize a solid matter such as biomass. Biomass here refers to renewable, biological organic resources. For example, biomass includes forest thinning, scrap wood material, driftwood, herbaceous, waste products, sludge, tires, recycle fuel (pellet and chips) made from these materials, and others, but is not limited to the foregoing ones. In addition, the vertical mill of the embodiment is not limited to a mill dedicated for pulverizing a biomass solid matter, but can also pulverize coal and mixtures of a biomass solid matter and coal.

In the vertical mill of embodiment 1, as illustrated in FIGS. 1 to 3, a housing 11 is formed in a cylindrical hollow shape, and has a biomass supply pipe 12 thereon. The biomass supply pipe 12 is intended to supply a biomass solid matter from a not illustrated biomass supply device into the housing 11, and is disposed in an up-down (vertical) direction at a center of the housing 11, and has a lower end part extending downward.

The housing 11 has a pulverization table 13 at a lower part thereof. The pulverization table 13 is disposed at the center of the housing 11 so as to be opposed to the lower end part of the biomass supply pipe 12. In addition, the pulverization table 13 is connected at a lower part thereof to a rotation shaft 14 with a vertical rotation axis core, and is rotatably supported in the housing 11. The rotation shaft 14 has a worm wheel 15 as a drive gear fixed thereto, and a worm gear 16 of a drive motor (not illustrated) mounted in the housing 11 engages with the worm wheel 15. Therefore, the drive motor allows the pulverization table 13 to be capable of being driven and rotated via the worm gear 16, the worm wheel 15, and the rotation shaft 14.

In addition, the pulverization table 13 has a ring-shaped table liner 17 fixed thereto at an outer peripheral side. The table liner 17 has an inclined (top) surface that is higher with increasing proximity to an outer peripheral side of the pulverization table 13. A plurality of pulverization rollers 18 is arranged above the pulverization table 13 (table liner 17) so as to be opposed to the pulverization table 13 (table liner 17). Each of the pulverization rollers 18 is made along the surface of the pulverization table 13 (table liner 17) and swingable in a direction different from the direction of rotation of the pulverization table 13. In this case, each of roller swing mechanisms 19 allows the pulverization roller 18 to swing with the pulverization position of the pulverization roller 18 on the pulverization table 13 or a position on the radial outside of the pulverization position on the pulverization table 13, as a fulcrum point.

Specifically, the support shaft 21 is swingable at a leading end part in the up-down direction when the support shaft 21 is supported at a trailing end part by a trunnion 22 at a side wall part of the housing 11. The support shaft 21 has the leading end part that faces the rotation axis core of the pulverization table 13 and inclines downward. A swing shaft 23 has a base end part connected swingably to the leading end part of the support shaft 21 via an approximately vertical connecting shaft 24. The pulverization roller 18 is attached rotatably to a leading end part of the swing shaft 23 by a bearing not illustrated.

In this case, the connecting shaft 24 is desirably configured such that the outer peripheral surface of the pulverization roller 18 is approximately perpendicular to the surface of the pulverization table 13 (table liner 17), whereby the pulverization roller 18 is swingable with a predetermined gap described later between the pulverization roller 18 and the pulverization table 13. In addition, the connecting shaft 24 connecting the support shaft 21 to the swing shaft 23 is positioned at a center of swing of the pulverization roller 18. The center of swing is positioned desirably closer to the pulverization position of the pulverization roller 18 on the pulverization table 13, whereby the pulverization roller 18 can exert a proper shearing force on a solid matter such as biomass.

In addition, the support shaft 21 is provided with an upper arm 25 extending upward. A leading end part of the upper arm 25 is connected to a leading end part of a pressure rod 27 of a hydraulic cylinder 26 as a pressing device fixed to the housing 11. The support shaft 21 is provided with a lower arm 28 extending downward, and a leading end part of the lower arm 28 can be abut to a stopper 29 fixed to the housing 11. Therefore, when the pressure rod 27 is advanced by the hydraulic cylinder 26, the pressure rod 27 presses the upper arm 25 and rotates the support shaft 21 clockwise with the trunnion 22 as a fulcrum point as illustrated in FIG. 3. At that time, the lower arm 28 abuts the stopper 29 to define the rotational position of the support shaft 21.

That is, the pulverization roller 18 is intended to pulverize a biomass solid matter between the pulverization roller 18 and the pulverization table 13 (table liner 17). It is thus necessary to provide a predetermined gap between the surface of the pulverization roller 18 and the surface of the pulverization table 13 (table liner 17). Accordingly, when the hydraulic cylinder 26 defines the predetermined rotational position of the support shaft 21, it is possible to provide a predetermined gap for taking in and pulverizing a biomass solid matter between the surface of the pulverization roller 18 and the surface of the pulverization table 13.

In this case, when the pulverization table 13 rotates, a biomass solid matter supplied on the pulverization table 13 moves toward the outer periphery by a centrifugal force and enters between the pulverization roller 18 and the pulverization table 13. Since the pulverization roller 18 is pressed toward the pulverization table 13, the rotational force of the pulverization table 13 is transferred to the pulverization roller 18 through the biomass solid matter. Accordingly, the pulverization roller 18 can rotate in conjunction with the rotation of the pulverization table 13.

In addition, two hydraulic cylinders 41 and 42 constituting the roller swing mechanism 19 are intervened between the support shaft 21 and the swing shaft 23 (pulverization roller 18). Specifically, the hydraulic cylinders 41 and 42 are disposed on horizontal sides of the support shaft 21 and the swing shaft 23, and base end parts thereof are rotatably connected by connecting pins 44 to a support device 43 integrated with the support shaft 21. In addition, the hydraulic cylinders 41 and 42 have drive rods 45 and 46 at leading end parts rotatably connected by connecting pins 47 to the leading end part (pulverization roller 18) of the swing shaft 23. In this case, the connecting pins 44 and 47 are each parallel to the connecting shaft 24.

Therefore, when the hydraulic cylinders 41 and 42 are alternately extended and contracted, the pulverization roller 18 is allowed to swing, that is, twist on the pulverization table 13. In this case, as illustrated in FIG. 1, the pulverization roller 18 can swing between positions 18*a* and 18*b* represented by two-dot chain lines, and has a swing angle θ set around a center O. In addition, the center of swing of the pulverization roller 18 is desirably set at the pulverization position of the pulverization roller 18, that is, the position of contact between the pulverization roller 18 and the pulverization table 13. In this embodiment, however, for simplification of the structure, the center of pulverization of the pulverization roller 18 is set at the connecting shaft 24 connecting the support shaft 21 and the swing shaft 23, which is nearer the radial outside of the pulverization table 13 than the pulverization position of the pulverization roller 18. Nevertheless, the connecting shaft 24 is provided nearer the pulverization position of the pulverization roller 18 than an intermediate position of an axial length of the support shaft 21 and the swing shaft 23.

In this embodiment, the pulverization roller 18 is configured to have the shape of a conical trapezoid so as to be smaller in diameter at the leading end part, and have a flat surface. However, the pulverization roller 18 is not limited to this shape. For example, the pulverization roller 18 may have the shape of a tire. In addition, in this embodiment, a plurality of (three) pulverization rollers 18 is disposed at regular intervals along the direction of rotation of the pulverization table 13. In this case, the number and layout of the pulverization rollers 18 may be set as appropriate according to the sizes of the pulverization table 13 and the pulverization rollers 18, and the like.

The housing 11 has an inlet port 31 into which primary air is fed, at a lower part thereof on the outer periphery of the pulverization table 13. The housing 11 also has an outlet port 32 from which pulverized biomass is discharged, at an upper part thereof on the outer periphery of a biomass supply pipe 12. In addition, the housing 11 has under the outlet port 32 a rotary separator 33 as a classification device classifying pulverized biomass. The rotary separator 33 is disposed on an outer periphery part of the biomass supply pipe 12, and can be driven and rotated by the drive device 34. The housing 11 also has a foreign matter discharge pipe 35 at the lower part thereof. The foreign matter discharge pipe 35 is intended to drop and discharge foreign matter (spillage) such as gravel and metal strips mixed in a biomass solid matter, from the outer peripheral part of the pulverization table 13.

In the thus configured vertical mill of the embodiment, when a solid matter such as biomass is supplied from the biomass supply pipe 12 into the housing 11, the solid matter falls through the biomass supply pipe 12 and is supplied onto the center of the pulverization table 13. At that time, since the pulverization table 13 rotates at a predetermined speed, the solid matter supplied on the center of the pulverization table 13 moves so as to be scattered all around by the action of a centrifugal force, and forms a uniform layer on the entire surface of the pulverization table 13. That is, the solid matter such as biomass enters between the pulverization roller 18 and the pulverization table 13.

Accordingly, the rotative force of the pulverization table 13 is transferred to the pulverization roller 18 via the solid matter such as biomass, and the pulverization roller 18 rotates together with the rotation of the pulverization table 13. At that time, since the pulverization roller 18 is pressed and supported by the hydraulic cylinder 26 toward the pulverization table 13, the pulverization roller 18 rotates while pressing and pulverizing the solid matter. In addition, at that time, since the hydraulic cylinders 41 and 42 constituting the roller swing mechanism 19 repeats alternate extension and contraction, the pulverization roller 18 swings from side to side on the pulverization table 13. Accordingly, the pulverization roller 18 can swing while rotating to exert a shearing force on the solid matter while pressuring the same, thereby cutting and pulverizing the fibers and the like of the solid matter.

The solid matter pulverized by the pulverization roller 18 is dried and raised by primary air fed from the inlet port 31 into the housing 11. The raised pulverized solid matter is classified by the rotary separator 33. Coarse powder is dropped and returned to the pulverization table 13 for re-pulverization, whereas fine powder passes through the rotary separator 33 and is discharged by an air current through the outlet port 32. In addition, spillage such as gravel and metal strips mixed in the solid matter such as biomass is dropped outward from the outer peripheral part by a centrifugal force of the pulverization table 13, and then is discharged from the foreign matter discharge pipe 35.

As in the foregoing, in the vertical mill of embodiment 1, the pulverization table 13 is supported so as to be capable of being driven and rotated with the vertical rotation axis core within the housing 11, and the pulverization roller 18 is disposed above the pulverization table 13 so as to be opposed to the pulverization table 13 in a manner capable of rotating in conjunction with the rotation of the pulverization table 13, and the roller swing mechanism 19 is provided such that the pulverization roller 18 is parallel to the surface of the pulverization table 13 and can swing in a direction different from the direction of rotation of the pulverization table 13.

Therefore, when the pulverization table 13 is driven and rotated, and when a solid matter such as biomass is supplied onto the pulverization table 13, the solid matter moves outward by a centrifugal force, and enters between the pulverization table 13 and the pulverization roller 18. Then, the pulverization roller 18 rotates in conjunction with the rotation of the pulverization table 13, thereby to pulverize the solid matter. At that time, the roller swing mechanism 19 allows the pulverization roller 18 to swing to exert a shearing force on the solid matter for facilitation of pulverization. Accordingly, the solid matter such as biomass can be efficiently pulverized, thereby achieving improvement in efficiency of pulverization. In addition, the pulverization roller 18 swings in a direction different from the direction of rotation of the pulverization table 13, which allows the outer peripheral surface of the pulverization roller 18 and the surface of the pulverization table 13 (table liner 17) to be evenly worn and lengthened in life time.

In addition, in the vertical mill of embodiment 1, the roller swing mechanism 19 is characterized by being capable of swinging the pulverization roller 18, with the pulverization position of the pulverization roller 18 on the pulverization table 13 or the position nearer the radial outside of the pulverization table 13 than the pulverization position as a fulcrum point. Therefore, the pulverization roller 18 can exert efficiently a shearing force on the solid matter such as biomass, thereby cutting fiber of the biomass and pulverizing the solid matter efficiently.

In addition, in the vertical mill of embodiment 1, the base end part of the support shaft 21 is supported at the housing 11, the leading end part of the support shaft 21 is faced toward the rotation axis core of the pulverization table 13, the base end part of the swing shaft 23 is swingably connected to the leading end part of the support shaft 21, and the pulverization roller 18 is rotatably supported at the leading end part of the swing shaft 23. Therefore, when the swing shaft 23 swings with respect to the support shaft 21, the pulverization roller 18 swings accordingly, which allows the pulverization roller 18 to be swingably supported in an easy manner.

In addition, in the vertical mill of embodiment 1, the hydraulic cylinders (actuators) 41 and 42 are provided as the roller swing mechanism 19 capable of swinging the pulverization roller 18. Therefore, the pulverization roller 18 can be easily swung by the hydraulic cylinders 41 and 42. In this case, the actuators constituting the roller swing mechanism 19 are not limited to the hydraulic cylinders 41 and 42, but may be air cylinders or may be configured with a motor and a cam mechanism.

Embodiment 2

Figure 4:
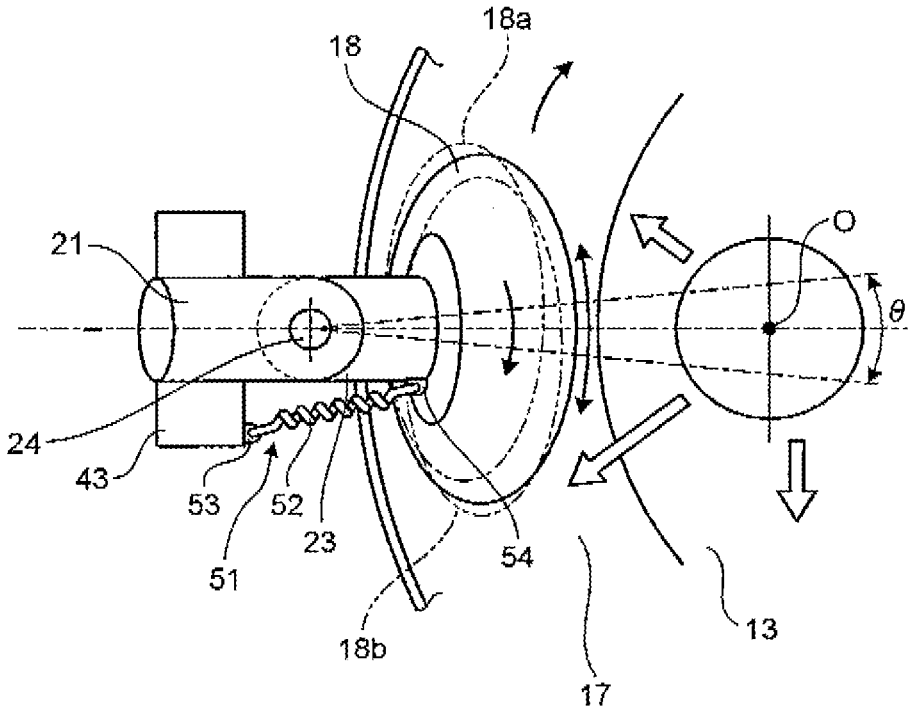
FIG. 4 is a plan view of a pulverization roller in a vertical mill according to embodiment 2 of the present invention.

FIG. 4 is a plane view of a pulverization roller in a vertical mill according to embodiment 2 of the invention. Members with the same functions as those of the foregoing embodiment are given the same reference signs as those of the foregoing embodiment, and descriptions thereof are omitted here.

In the vertical mill of embodiment 2, as illustrated in FIG. 4, a plurality of pulverization rollers 18 is disposed above the pulverization table 13 (table liner 17) so as to be opposed to the pulverization table 13 (table liner 17), and a roller swing mechanism 51 makes each of the pulverization roller 18 parallel to the surface of the pulverization table 13 (table liner 17) and swingable in a direction different from the direction of rotation of the pulverization table 13.

Specifically, the support shaft 21 has a leading end part to which the swing shaft 23 is swingably connected by the connecting shaft 24, and the pulverization roller 18 is rotatably attached to a leading end part of the swing shaft 23. In addition, an extension spring 52 is provided as a biasing member constituting the roller swing mechanism 51, and is intervened between the support shaft 21 and the swing shaft 23 (pulverization roller 18). Specifically, the extension spring 52 is disposed on one horizontal side of the support shaft 21 and the swing shaft 23, that is, on an upstream side of the direction of rotation of the pulverization table 13. The extension spring 52 has one end part connected to a bracket 53 of the support device 43, and has the other end part connected to a bracket 54 of the swing shaft 23 (pulverization roller 18).

In the thus configured vertical mill of the embodiment, when a solid matter such as biomass is supplied from the biomass supply pipe 12 onto the center of the pulverization table 13, since the pulverization table 13 rotates, the solid matter moves so as to be scattered all around by a centrifugal force, and enters between the pulverization roller 18 and the pulverization table 13. Accordingly, the rotative force of the pulverization table 13 is transferred to the pulverization roller 18 via the solid matter, thereby to rotate the pulverization roller 18. At that time; since the pulverization roller 18 is pressed and supported by the hydraulic cylinder 26, the pulverization roller 18 rotates while pressing and pulverizing the solid matter.

In addition, at that time, the pulverization roller 18 is swingable with respect to the housing 11 (support shaft 21) together with the swing shaft 23, and is biased and supported by the extension spring 52 constituting the roller swing mechanism 51 on the upstream side of the direction of rotation of the pulverization table 13. Accordingly, when the rotative force of the pulverization table 13 is transferred to the pulverization roller 18 via the solid matter, the transferred force becomes larger than the biasing force of the extension spring 52, and the pulverization roller 18 swings to the downstream side of the direction of rotation of the pulverization table 13 on the pulverization table 13. Then, when the force transferred from the pulverization table 13 to the pulverization roller 18 via the solid matter becomes smaller than the biasing force of the extension spring 52 depending on the pulverization state of the solid matter pulverized by the pulverization roller 18, the pulverization roller 18 swings toward the upstream side of the direction of rotation of the pulverization table 13 on the pulverization table 13 by the biasing force of the extension spring 52. As in the foregoing, the pulverization roller 18 can swing while rotating to exert a shearing force on the solid matter while pressuring the same, thereby cutting and pulverizing the fibers and the like of the solid matter.

After that, the solid matter pulverized by the pulverization roller 18 is dried and raised by primary air fed from the inlet port 31 into the housing 11. The raised pulverized solid matter is classified by the rotary separator 33. Coarse powder is dropped and returned to the pulverization table 13 for repulverization, whereas fine powder passes through the rotary separator 33 and is discharged by an air current through the outlet port 32. In addition, spillage such as gravel and metal strips mixed in the solid matter such as biomass is dropped outward from the outer peripheral part by a centrifugal force of the pulverization table 13, and then is discharged from the foreign matter discharge pipe 35.

As in the foregoing, in the vertical mill of embodiment 2, the pulverization table 13 is supported so as to be capable of being driven and rotated with the vertical rotation axis core within the housing 11, and the pulverization roller 18 is disposed above the pulverization table 13 so as to be opposed to the pulverization table 13 in a manner capable of rotating in conjunction with the rotation of the pulverization table 13, and the roller swing mechanism 51 is provided such that the pulverization roller 18 is parallel to the surface of the pulverization table 13 and can swing in a direction different from the direction of rotation of the pulverization table 13.

Therefore, the solid matter such as biomass supplied onto the pulverization table 13 moves by a centrifugal force and enters between the pulverization table 13 and the pulverization roller 18. Then, the pulverization roller 18 rotates in conjunction with the rotation of the pulverization table 13, thereby to pulverize the solid matter. At that time, the roller swing mechanism 51 allows the pulverization roller 18 to swing to exert a shearing force on the solid matter for facilitation of pulverization. Accordingly, the solid matter such as biomass can be efficiently pulverized, thereby achieving improvement in efficiency of pulverization.

In addition, in the vertical mill of embodiment 2, the extension spring (biasing member) 52 is provided as the roller swing mechanism 51 to bias the pulverization roller 18 to the upstream side of rotation direction of the pulverization table 13. Therefore, the pulverization roller 18 swings to the downstream side of rotation direction by transfer of rotative force of the pulverization table 13. On the other hand, the pulverization roller 18 swings to the upstream side of rotation direction by the biasing force of the extension spring 52 when the rotative force of the pulverization table 13 is lowered depending on the pulverized state of the solid matter. Accordingly, the pulverization roller 18 can be swung by the simple configuration.

In the embodiment, the biasing force of the extension spring 52 is set according to a friction force among the pulverization roller 18, the solid matter, and the pulverization table. The friction force varies depending on the pulverization state of the solid matter pulverized by the pulverization roller 18, that is, the amount and the size, and the like of the solid matter entering between the pulverization roller 18 and the pulverization table. In addition, with increase in the friction force, the pulverization roller 18 swings to the downstream side of rotation direction of the pulverization table 13, and with decrease in the friction force, the pulverization roller 18 swings to the upstream side of rotation direction of the pulverization table 13 due to the biasing force of the extension spring 52.

In this case, the extension spring 52 may be disposed on both horizontal sides of the support shaft 21 and the swing shaft 23, so as to set larger the biasing force of the extension spring 52 disposed on the upstream side of rotation direction of the pulverization table 13. In addition, the hydraulic cylinders 41 and 42 described above in relation to embodiment 1 may be used in combination with the extension springs 52.

In addition, in each of the foregoing embodiments, the swing shaft 23 is swingably supported by the connecting shaft 24 at the leading end part of the support shaft 21 supported at the housing 11, and the pulverization roller 18 is attached to the leading end part of the swing shaft 23. However, the invention is not limited to the configuration. For example, the housing 11 may use a four-joint link mechanism to support the pulverization roller 18. In addition, the pulverization roller 18 may be supported immediately thereabove by a vertical shaft so as to be capable of turning (swinging).

Further, in each of the foregoing embodiments, the pulverization roller 18 may be formed with grooves or asperities (dimples) on the outer peripheral surface using ceramics or wear resistance steel.

The vertical mill according to the invention allows a solid matter such as biomass to be efficiently pulverized by making the pulverization roller parallel to the surface of the pulverization table and swingable in a direction different from the rotation direction of the pulverization table, thereby achieving improvement in pulverization efficiency, and is applicable to apparatuses for pulverizing a solid matter such as biomass.

The invention claimed is:

1. A vertical mill, comprising:

a housing;

a vertical rotation axis core;

a pulverization table supported by the vertical rotation axis core in the housing so as to be driven and rotated;

a pulverization roller disposed above the pulverization table so as to be opposed to the pulverization table and being rotatable in conjunction with rotation of the pulverization table;

a roller swing mechanism causing the pulverization roller to be parallel to a surface of the pulverization table and swingable in a direction different from a direction of rotation of the pulverization table;

a support shaft having a base end part supported by the housing and a leading end part facing a rotation axis core of the pulverization table; and a swing shaft having a leading end part and a base end part that is swingable connected to the leading end part of the support shaft via a connecting shaft inclined with respect to a horizontal plane, wherein the pulverization roller is rotatably supported at the leading end part of the swing shaft.

2. The vertical mill according to claim 1, wherein the roller swing mechanism is configured to cause the pulverization roller to swing around a pulverization position of the pulverization roller on the pulverization table or a position nearer a radial outside of the pulverization table other than the pulverization position, as a fulcrum point.

3. The vertical mill according to claim 1, wherein the roller swing mechanism includes an actuator configured to cause the pulverization roller to swing.

4. The vertical mill according to claim 1, wherein the roller swing mechanism includes a biasing member configured to bias the pulverization roller to an upstream side of a direction of rotation of the pulverization table.

5. The vertical mill according to claim 1, wherein the roller swing mechanism includes hydraulic cylinders disposed on horizontal sides of the support shaft and the swing shaft.

6. The vertical mill according to claim 5, wherein the hydraulic cylinders are configured to be capable of alternately extending and contracting so as to enable the pulverization roller to swing on the pulverization table.

7. The vertical mill according to claim 1, wherein the swing shaft, the support shaft and the connecting shaft are configured and arranged to enable three dimensional movement of the pulverization roller.

8. The vertical mill according to claim 1, wherein the swing shaft and the support shaft are connected by the connecting shaft so as to enable horizontal movement.

* * * * *